US011390367B2

(12) United States Patent
Brackett et al.

(10) Patent No.: US 11,390,367 B2
(45) Date of Patent: Jul. 19, 2022

(54) MODULAR RUDDER SYSTEM

(71) Applicant: Hobie Cat IP, LLC, Oceanside, CA (US)

(72) Inventors: Drew William Brackett, Solana Beach, CA (US); William John Broadway, Encinitas, CA (US); James Taylor Czarnowski, Fallbrook, CA (US); Mark Joseph Johnson, Dana Point, CA (US); Jason Christopher Kardas, Oceanside, CA (US); Victor Daniel Ortiz, San Marcos, CA (US); Elizabeth Catherine Sexton, San Clemente, CA (US); Shane Yellin, Carlsbad, CA (US); Philip James Dow, Oceanside, CA (US)

(73) Assignee: Hobie Cat IP, LLC, Livonia, MI (US)

( * ) Notice: Subject to any disclaimer, the term of this patent is extended or adjusted under 35 U.S.C. 154(b) by 4 days.

(21) Appl. No.: 16/948,128

(22) Filed: Sep. 3, 2020

(65) Prior Publication Data

US 2022/0063788 A1 Mar. 3, 2022

(51) Int. Cl.
*B63H 25/38* (2006.01)

(52) U.S. Cl.
CPC ..... *B63H 25/38* (2013.01)

(58) Field of Classification Search
CPC ..... B63H 25/00; B63H 25/38; B63B 35/79; B63B 35/7926; B63B 35/00
USPC ..... 114/162, 165; 440/13, 21
See application file for complete search history.

(56) References Cited

U.S. PATENT DOCUMENTS

| | | | |
|---|---|---|---|
| 4,556,006 | A | 12/1985 | Kaupat |
| 4,941,423 | A | 7/1990 | Van Tassel |
| 5,349,918 | A | 9/1994 | Elie |
| 5,386,368 | A | 1/1995 | Knight |
| 5,465,633 | A | 11/1995 | Bernloehr |
| 5,669,794 | A | 9/1997 | Knight et al. |
| D399,478 | S | 10/1998 | Strandell |
| 5,884,213 | A | 3/1999 | Carlson |

(Continued)

FOREIGN PATENT DOCUMENTS

| | | |
|---|---|---|
| CA | 3035190 | 8/2020 |
| CN | 211001732 | 7/2020 |

(Continued)

OTHER PUBLICATIONS

[No Author Listed], "Parts & Accessories." Hobie Dealer Copy, Hobie Cat Company, Spring / Summer 2010, 52 pages.

(Continued)

*Primary Examiner* — Lars A Olson
(74) *Attorney, Agent, or Firm* — Fish & Richardson P.C.

(57) ABSTRACT

A stand-alone modular removable rudder system for watercraft having a rudder comprising a steering handle coupled to a quick release mechanism adapted to releasably secure said steering handle to said watercraft in proximity to the operator, said system further comprising, a rudder mount adapted to be coupled to the rear of the watercraft by a quick release mechanism adapted to releasably secure said rudder mount to said watercraft, said rudder being carried by a rudder support pivotal about said rudder mount and cables operatively connecting said steering handle to said rudder mount whereby the steering handle can be operated to steer the rudder.

20 Claims, 23 Drawing Sheets

(56) References Cited

U.S. PATENT DOCUMENTS

| | | | | |
|---|---|---|---|---|
| 5,957,078 | A | 9/1999 | Van Tassel | |
| 6,022,249 | A | 2/2000 | Ketterman | |
| 6,213,821 | B1 | 4/2001 | Bernloehr et al. | |
| 6,254,441 | B1 | 7/2001 | Knight et al. | |
| 6,369,542 | B1 | 4/2002 | Knight | |
| 6,394,859 | B1 | 5/2002 | Knight et al. | |
| 6,431,923 | B1 | 8/2002 | Knight et al. | |
| 6,612,252 | B2 | 9/2003 | King et al. | |
| 6,990,920 | B2 | 1/2006 | Hamilton et al. | |
| 7,086,914 | B1 | 8/2006 | Beamer et al. | |
| 7,195,526 | B2 | 3/2007 | Bernloehr et al. | |
| 7,320,291 | B2 | 1/2008 | Eckert | |
| 7,381,108 | B1 | 6/2008 | Salmon | |
| 7,430,976 | B2 | 10/2008 | Ketterman et al. | |
| 7,497,748 | B2 | 3/2009 | Salmon | |
| 7,637,791 | B2 | 12/2009 | Ketterman et al. | |
| 7,681,513 | B1 * | 3/2010 | Hundertmark | B63H 25/00 114/150 |
| 7,722,417 | B2 | 5/2010 | Bernloehr et al. | |
| 7,972,188 | B2 | 7/2011 | Bernloehr et al. | |
| 8,082,871 | B2 | 12/2011 | Czarnowski et al. | |
| 8,753,156 | B2 | 6/2014 | Ketterman et al. | |
| 8,869,731 | B2 | 10/2014 | Dow et al. | |
| 9,296,455 | B2 | 3/2016 | Bernloehr et al. | |
| 9,475,559 | B2 | 10/2016 | Czarnowski et al. | |
| 9,540,086 | B2 | 1/2017 | Ketterman et al. | |
| 9,604,703 | B2 | 3/2017 | Kardas et al. | |
| 9,623,944 | B2 | 4/2017 | Kuehmichel et al. | |
| 9,676,462 | B2 | 6/2017 | Bernloehr et al. | |
| 9,701,367 | B2 | 7/2017 | McDonough et al. | |
| 9,731,802 | B2 | 8/2017 | Ketterman et al. | |
| 9,981,726 | B2 | 5/2018 | Ketterman et al. | |
| 10,005,531 | B1 | 6/2018 | Broadway et al. | |
| 10,011,329 | B1 | 7/2018 | Cooper | |
| 10,035,575 | B2 | 7/2018 | Bernloehr et al. | |
| 10,046,837 | B2 | 8/2018 | Green et al. | |
| 10,196,120 | B2 | 2/2019 | Turek | |
| 10,259,553 | B2 | 4/2019 | Dow et al. | |
| 10,407,140 | B2 * | 9/2019 | Young | B63B 32/70 |
| 10,479,449 | B2 | 11/2019 | Cooper | |
| 10,758,049 | B2 | 9/2020 | Cooper | |
| 11,124,275 | B2 | 9/2021 | Robbins et al. | |
| 11,148,775 | B2 | 10/2021 | Kuehmichel | |
| 2002/0069809 | A1 | 6/2002 | King et al. | |
| 2008/0060569 | A1 | 3/2008 | Howard et al. | |
| 2013/0220208 | A1 | 8/2013 | Boyer | |
| 2018/0215447 | A1 | 8/2018 | Cooper | |
| 2020/0247516 | A1 | 8/2020 | Lammers-Meis et al. | |
| 2021/0001955 | A1 | 1/2021 | Cooper | |
| 2021/0047021 | A1 | 2/2021 | Boyer et al. | |
| 2021/0070411 | A1 | 3/2021 | Bragg | |
| 2021/0221477 | A1 | 7/2021 | Steed et al. | |
| 2021/0284309 | A1 | 9/2021 | Kuehmichel et al. | |
| 2021/0371057 | A1 | 12/2021 | Boyer et al. | |

FOREIGN PATENT DOCUMENTS

| | | |
|---|---|---|
| WO | WO 2008/016681 | 2/2008 |
| WO | WO 2009/017626 | 2/2009 |
| WO | WO 2010/017474 | 2/2010 |
| WO | WO 2017/019140 | 2/2017 |
| WO | WO 2018/009206 | 1/2018 |
| WO | WO 2018/126817 | 7/2018 |

OTHER PUBLICATIONS media.hobie.com [online], "Hobie Mirage Pro Angler Owner's Manual", Apr. 13, 2009, retrieved on Sep. 15, 2021, retrieved from URL <https://media.hobie.com/digital_assets/pro_angler_manual.pdf>, 16 pages.

Author Unknown, "Kayak Rudder", https://www.instructables.com/id/Kayak-rudder/, Outside Projects section, posted by yakhack in Outside>Boats, 2015.

International Search Report and Written Opinion in International Application No. PCT/US2021/048475, dated Dec. 20, 2021, 18 pages.

[No. Author Listed], "Hobi i11s Inflatable SUP/Kayak Setup for Fishing," Jan. 17, 2018, retrieved on Jan. 28, 2022, retrieved from URL <"https://www.youtube.com/watch?v==fh6owE5D2Y4&t=902s">, 3235 pages [Video Submission].

[No. Author Listed], "Pelican Catch 130 HyDryve Fishing Kayak Specs & Features Review and Walk-Around," Jul. 11, 2018, retrieved on Jan. 28, 2022, retrieved from URL <"https://www.youtube.com/watch?v=ZWGRX2FRtyo">, 396 pages [Video Submission].

[No. Author Listed], "Pelican The Catch 110HDII & The Catch 130HDII Fishing Pedal Drive Kayaks," Feb. 11, 2020, retrieved on Jan. 28, 2022, retrieved from URL <"https://www.youtube.com/watch?v=L3U3r8cKzCQ">, 742 pages [Video Submission].

[No. Author Listed], "Review Of The Catch 130HD," Sep. 20, 2019, retrieved on Jan. 28, 2022, retrieved from URL <"https://www.youtube.com/watch?v=eDKcE6XZQis">, 3020 pages [Video Submission].

Media.hobie.com [online], "Hobie Mirage Inflatable Kayak Manual," 2015, retrieved on Jan. 28, 2022, retrieved from URL <"https://media.hobie.com/digital_assets/Inflatable_Kayak_Manual.pdf">, 32 pages.

* cited by examiner

MODULAR RUDDER SYSTEM

BACKGROUND OF INVENTION

Watercraft such as kayaks, pedal boards and the like are normally steered by a rudder centrally positioned at the rear of the watercraft and pivot about a vertical axis. The rudder is steered using a steering handle which is either part of the rudder mechanism itself or is connected by cables to the rudder with the steering handle being located adjacent the operator of the watercraft who is normally positioned midway on the watercraft in a seated or standing position. Propulsion is provided by pedaling as disclosed, for example, in Ketterman, U.S. Pat. No. 6,022,249 and Czarnowski, et. al. U.S. Pat. No. 9,475,559, the disclosures of which are expressly incorporated herein by reference.

The rudder can also rotate about an axis transverse to the longitudinal dimension of the watercraft to be raised out of and lowered into the water, as described in the "Kayak Rudder" discussion posted to the Instructables.com do-it-yourself membership website's Outside projects section by an unidentified member in 2015. A hyperlink to this article can be found in the Information Disclosure Statement filed herewith.

In the prior art, the steering handle and the rudder are typically mechanically joined or built into the watercraft and require tools and extensive manual manipulation for their removal.

We have developed a stand-alone modular system whereby both the steering mechanism and the rudder mechanism can be easily slipped off, and on the watercraft, which after system removal, allows for the simplified carrying and storage of the watercraft.

The system can also be transferred from one watercraft to another.

BRIEF SUMMARY OF THE INVENTION

A stand-alone modular removable rudder system for watercraft having a rudder comprising a steering handle coupled to a quick release mechanism adapted to releasably secure said steering handle to said watercraft in proximity to the operator, said system further comprising, a rudder mount adapted to be coupled to the rear of the watercraft by a quick release mechanism adapted to releasably secure said rudder mount to said watercraft, said rudder being carried by a rudder support pivotal about said rudder mount and cables operatively connecting said steering handle to said rudder mount whereby the steering handle can be operated to steer the rudder.

A stand-alone modular removable rudder system for watercraft having a rudder comprising a steering handle coupled to a quick release mechanism adapted to releasably secure said steering handle to the watercraft in proximity to the operator, said system further comprising a rudder mount adapted to be coupled to the rear of the watercraft by a quick release mechanism adapted to releasably secure said rudder mount to said watercraft, said rudder being carried by a support pivotal about said rudder mount, and cables operatively connecting said steering handle to said rudder mount to pivot said rudder to steer, said rudder being rotatable on said rudder support about a transverse axis and a pull cord connected to said rudder support whereby the rudder can be rotated about said transverse axis and stowed on the deck of the watercraft.

BRIEF DESCRIPTION OF THE DRAWINGS

Turning to the drawings.

DETAILED DESCRIPTION OF THE PREFERRED EMBODIMENTS

One of the main advantages of the system is that it is a stand-alone, modular system which is capable of being quickly installed and removed from a variety of watercraft. This "quick-removal" feature is particularly important for inflatable craft that need to be deflated and folded up tightly as well as other watercraft where they are transported on the roof of a car and a rudder system makes this more difficult or dangerous. The rudder is raised and lowered using a single line that imparts a pivoting motion on the rudder blade and the weight of the blade carries it through to either a stowed or lowered position. The bungee keeps the rudder in either position. The overall rudder system of the invention comprises the quick release mechanisms for attaching the rudder and steering handle to the watercraft, the driving mechanism for the rudder which uses rotating quadrants, compression tubes and tensile cables and the integrated up/down feature using a single pull line.

Figure 1:
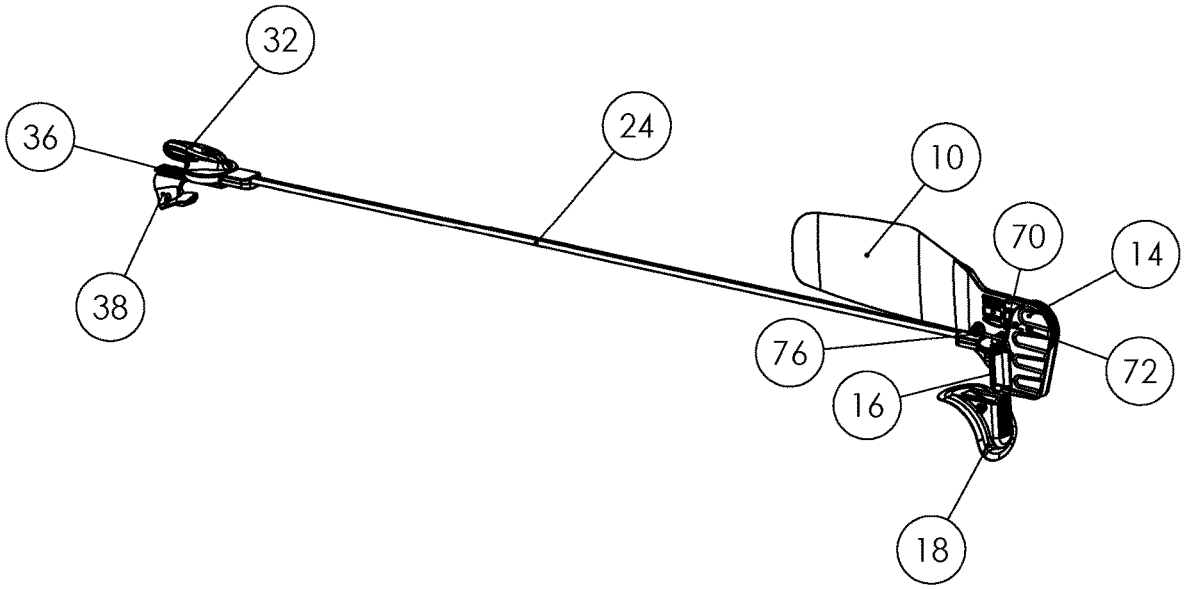
FIG. 1 is a perspective view of one preferred embodiment of the system of this invention showing a pedaled sit on kayak with the rudder prior to deployment and in the stowed position.
Figure 2:
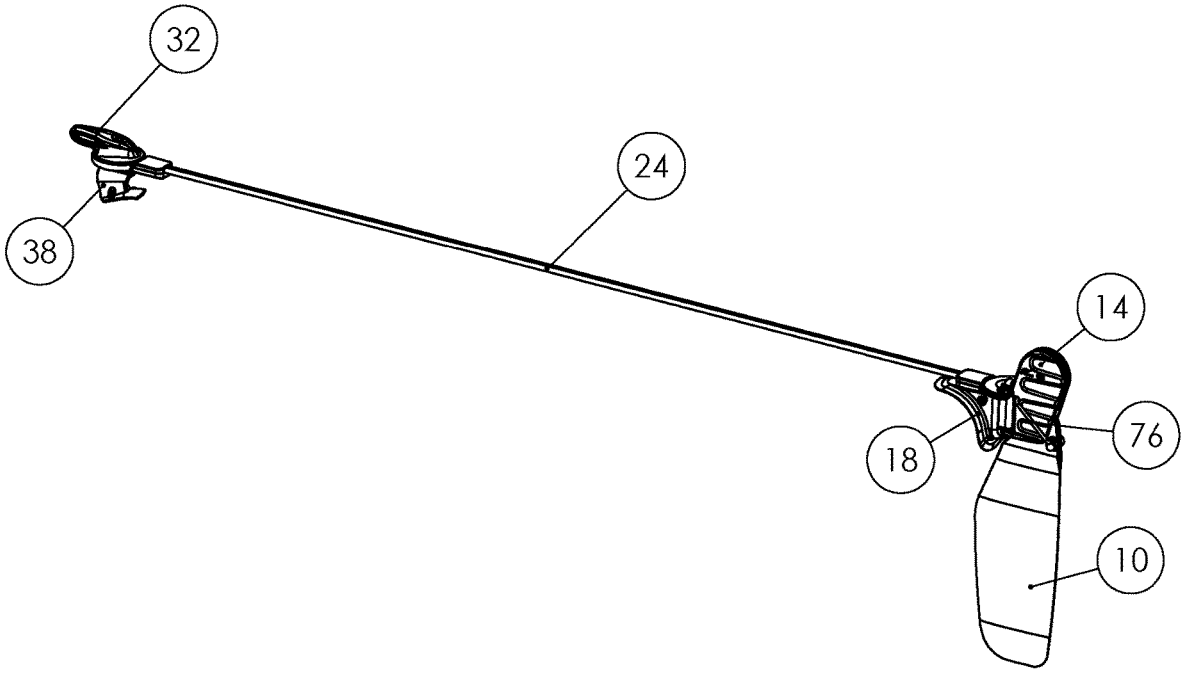
FIG. 2 is a perspective view of the embodiment of FIG. 1 with the rudder attached rotated in the deployed position.
Figure 3:
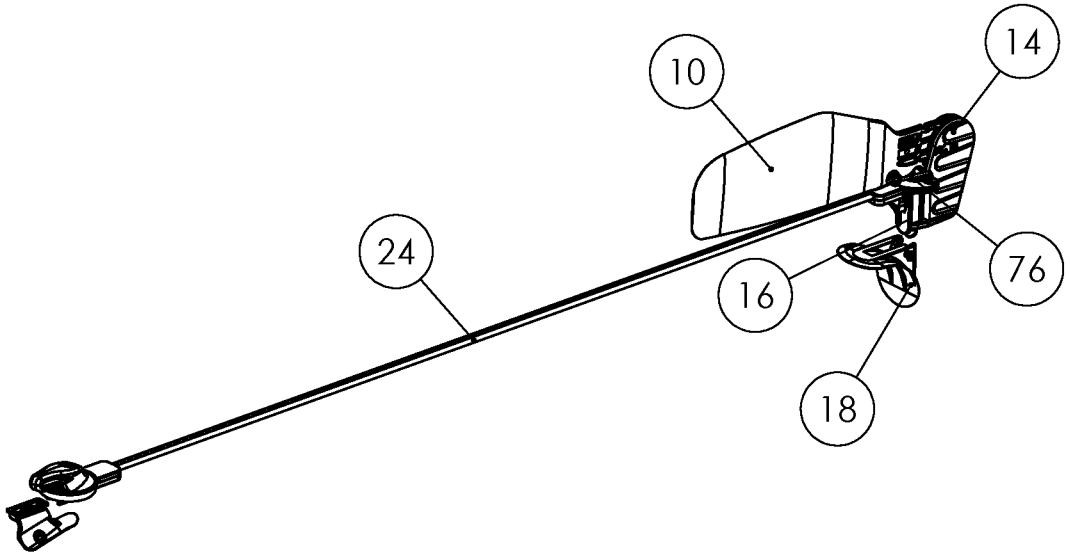
FIG. 3 is a perspective view of another embodiment of the system of this invention for a stand up pedaled board with the rudder prior to deployment and in the stowed position.
Figure 4:
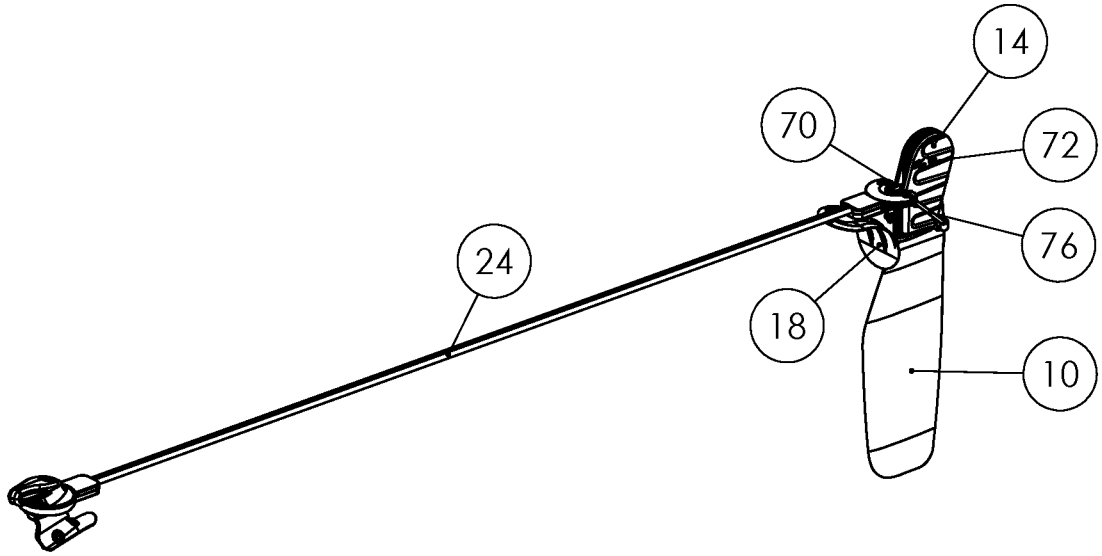
FIG. 4 is a perspective view of the embodiment of FIG. 3 with the rudder attached and rotated into the deployed position.
Figure 5:
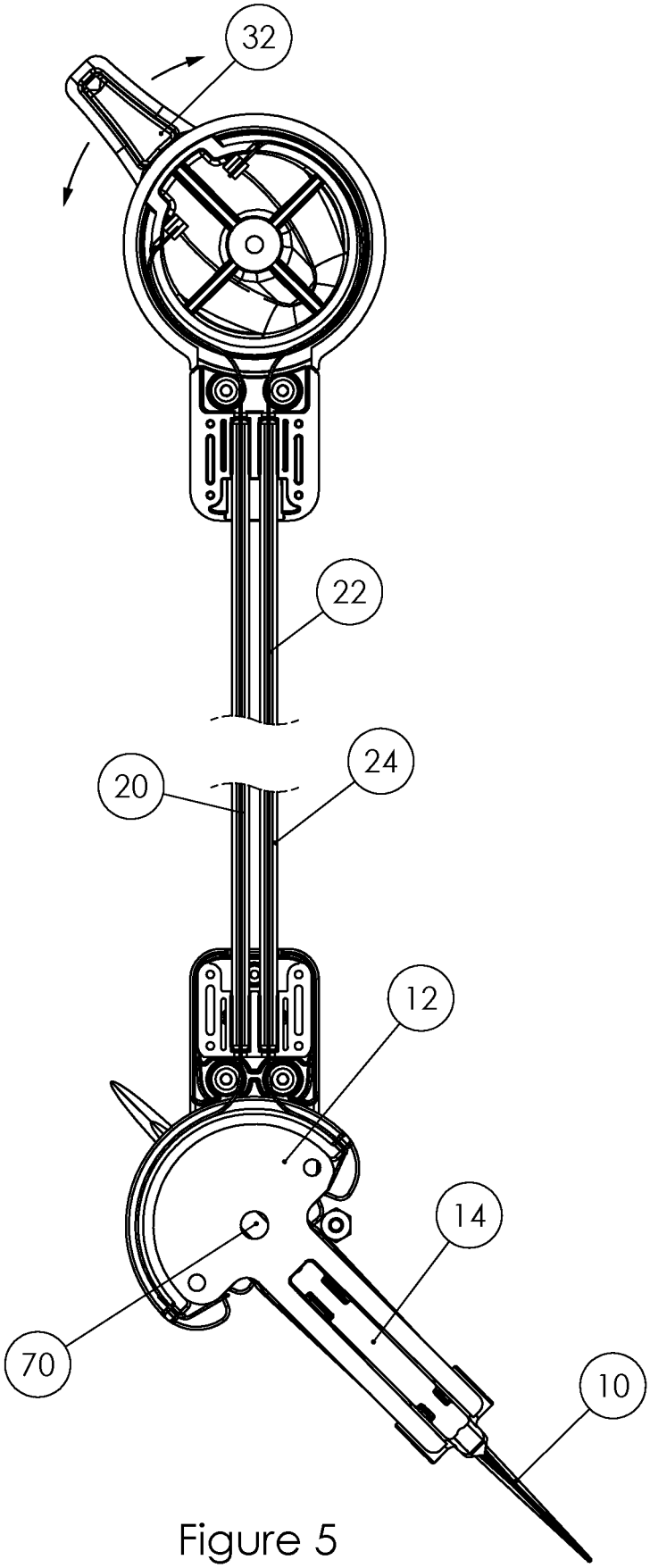
FIG. 5 is a top sectional away view of the system showing the connection of the cables to the steering handle and to the elements which pivot the rudder to steer, all common to both embodiments.
Figure 6:
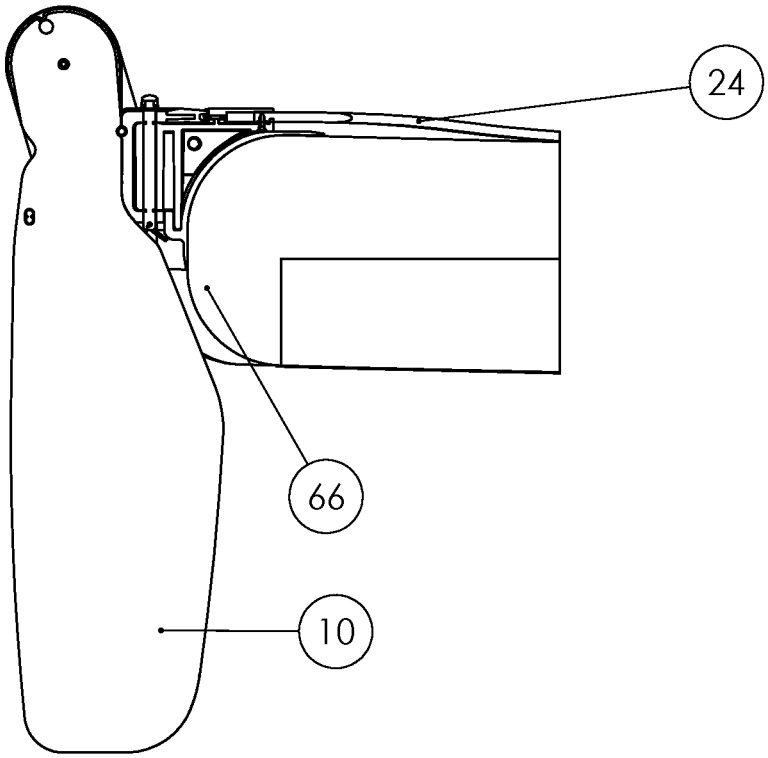
FIG. 6 is a partial side view with the rudder deployed and further showing the pull rope connection to the rudder support for rotating the rudder up and on to the deck from the deployed position.
Figure 6A:
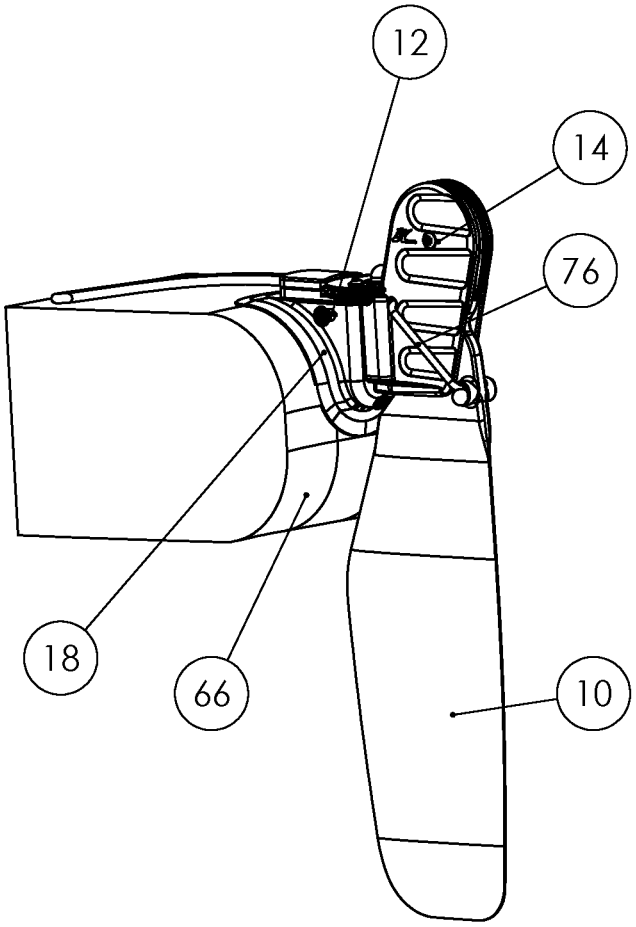
FIG. 6A is a partial perspective view showing the rear of the watercraft with the rudder in the deployed position, the pull rope for raising and lowering the rudder and bungee cords which serve to limit the relatively free rotational movement of the rudder about the rudder mount while allowing the deployed rudder to rotate sufficiently upon striking an obstacle in the water to avoid damage.

The stand alone modular removable rudder system comprises a rudder 10, rudder mount 12, rudder support 14, a projection 16 on the rudder mount and rudder retainer 18 which provides a quick releasable connection of the rudder mount 12 and rudder 10 to the watercraft. These elements are operated by tensile cables 20 and 22 generally shown in FIG. 5. The tensile cables are normally contained in a compression tube 24.

Figure 7:
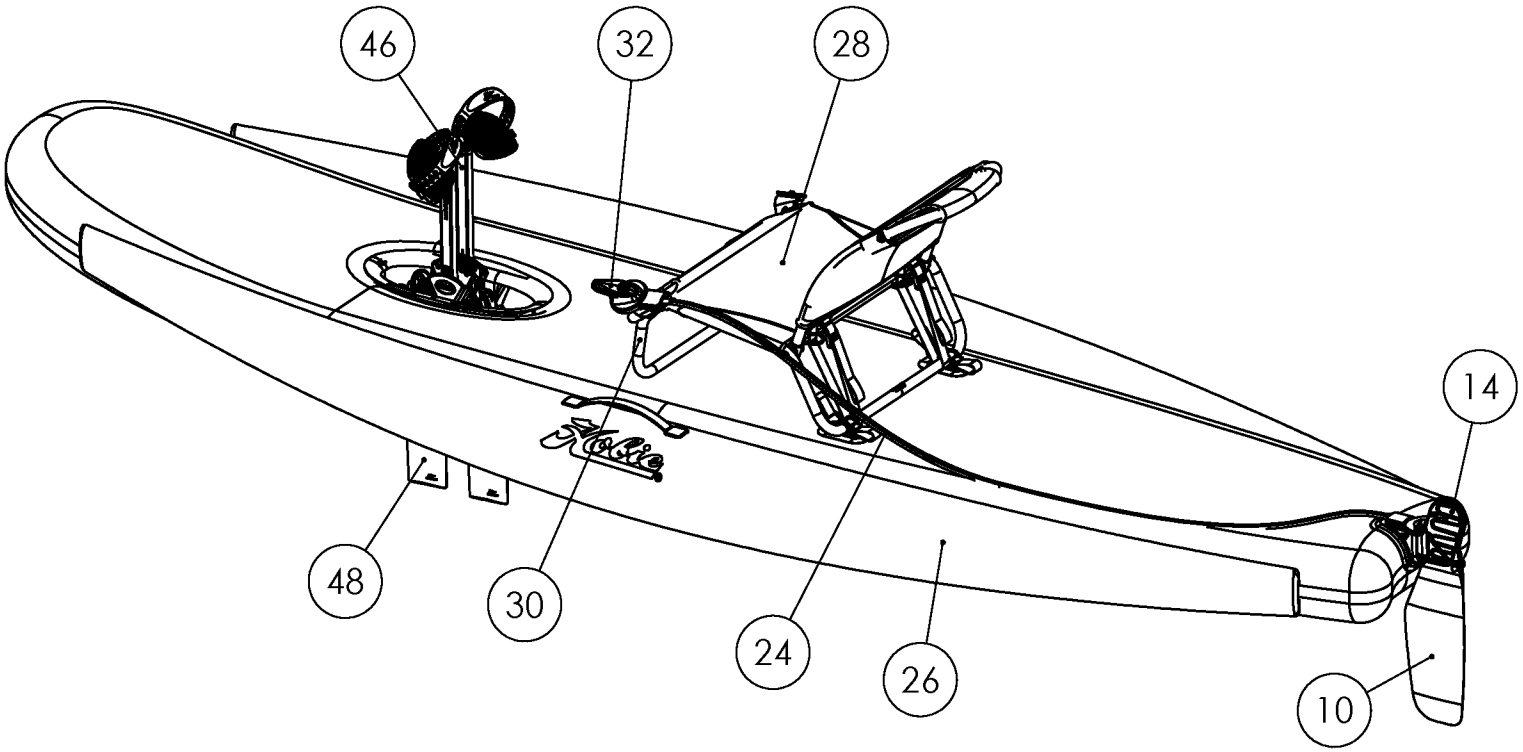
FIG. 7 is a perspective view of the system embodiment of FIGS. 1 and 2 installed on a pedaled sit on kayak watercraft.

The embodiment of the removable rudder systems of FIGS. 1, 2, 7 and 12A through 12E related to a pedaled sit on kayak 26 having a chair 28, shown in FIG. 7, for the operator. The chair normally has a tubular frame 30. The steering handle 32 is rotatably mounted in steering handle housing 34.

The steering handle housing retainer 38 is affixed to the tubular frame 30 of the chair by a bolt inserted through hole 40. The underside of the housing 34 has a slot for releasably receiving member 36 formed on retainer 38.

The retainer 38 has a hole 42 which receives a spring loaded quick release pin 44 which enters a hole in the housing 34. By pulling pin 44, the retainer 38 is easily separated from housing 34.

The embodiment of FIGS. 1, 2, 7 and 12A through 12E is propelled by the operator operating pedals 46 which move the flaps 48 in an arcuate path across the longitudinal dimension of the kayak 26.

Turing to the stand-up pedal board 50 embodiment shown in FIGS. 3, 4, 8 and 11, the rotatable steering handle 32 is rotatable in housing 52. There is a hollow tubular retainer 54 integral with the housing 52, one end of which provides a hand grip 56 for the operator, the opposite end 58 is adapted to snugly receive one free end of the handle bar 60 carried by upright 62, FIG. 11.

Figure 8:
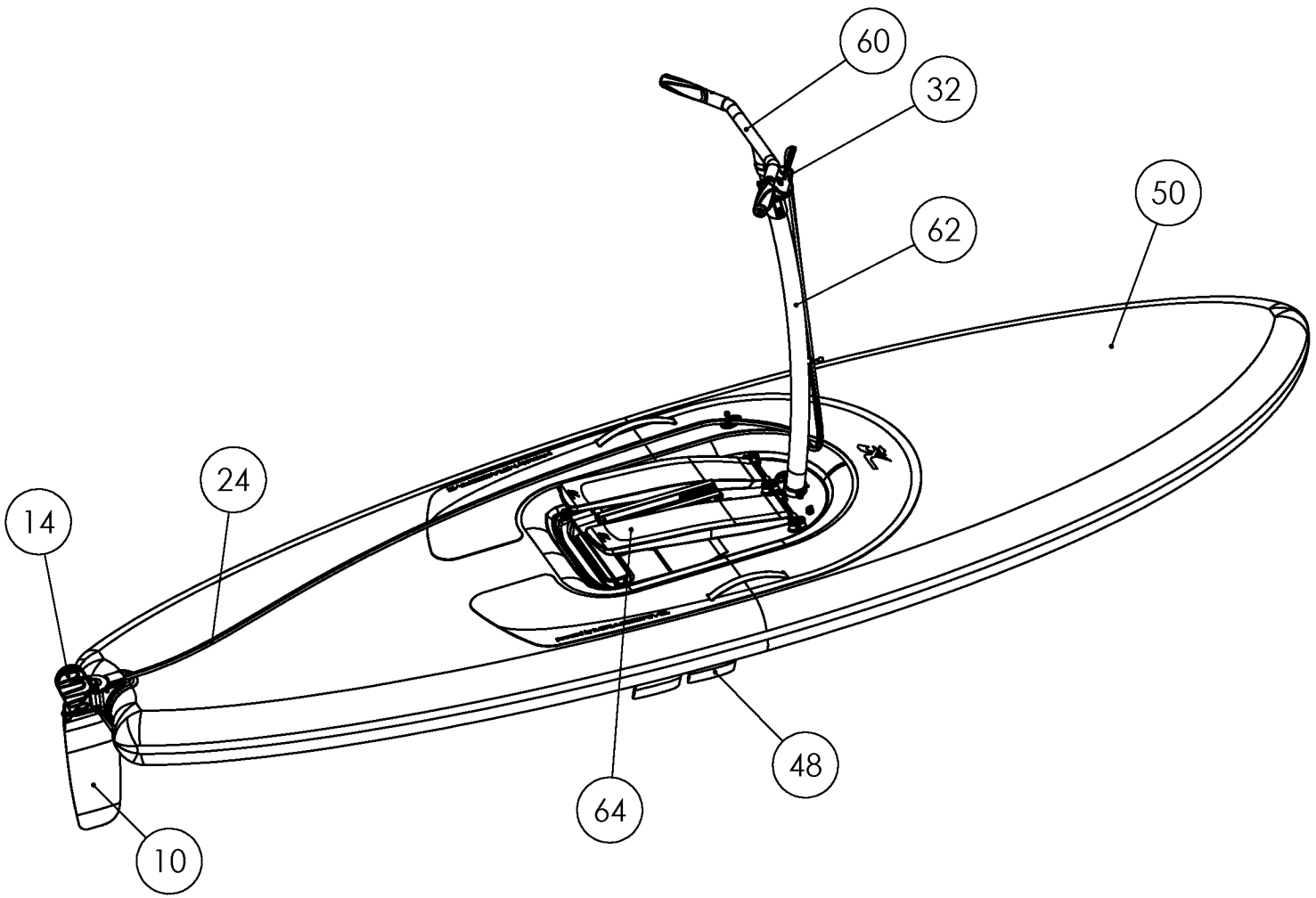
FIG. 8 is a perspective view of the system embodiment of FIGS. 3 and 4 installed on a stand up pedaled watercraft.
Figure 9:
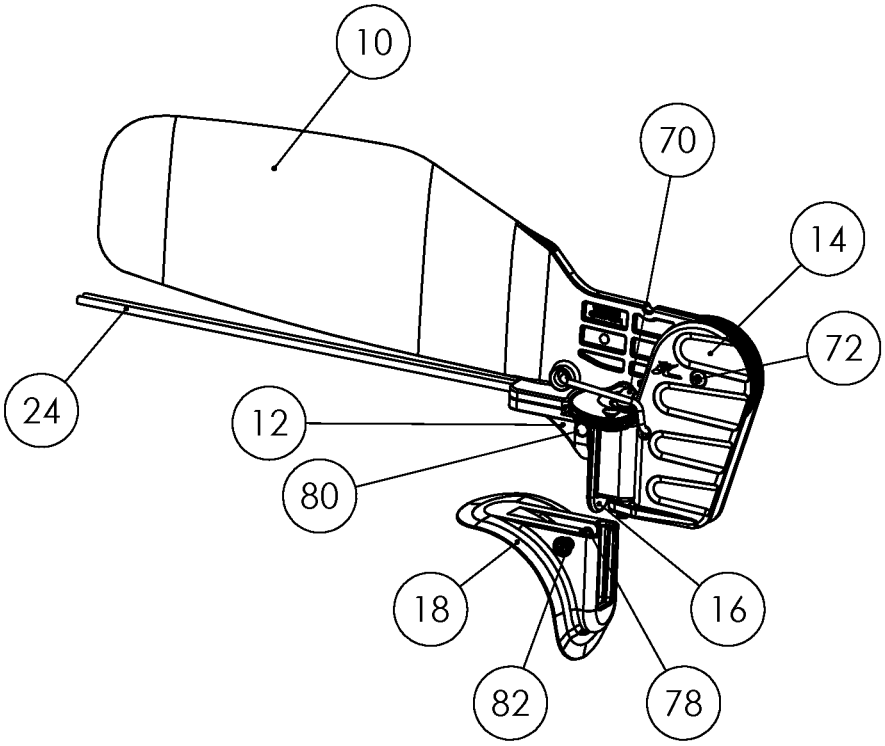
FIG. 9 is a partial side perspective view of the watercraft and rudder showing the retainer which is for attachment to the rear of the watercraft and the projection on the rudder mount in position to be releasably connected to the retainer and secured by a quick release pin.
Figure 10A:
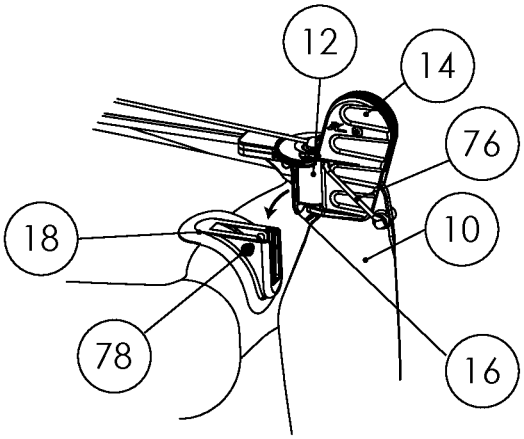
FIG. 10A shows the view of FIG. 9 showing the direction of movement as the retainer and rudder mount are slipped together.
Figure 10B:
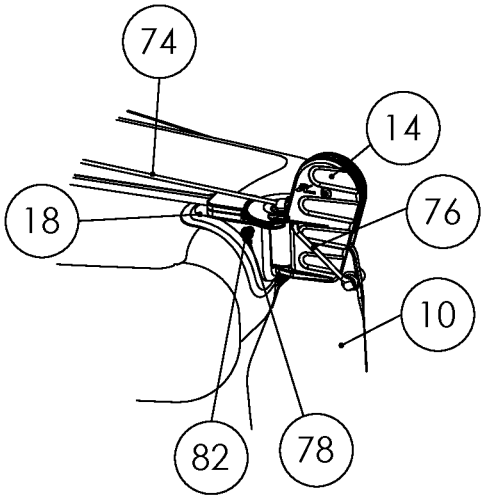
FIG. 10B shows the elements of FIGS. 9 and 10A slidably releasably connected.
Figure 10C:
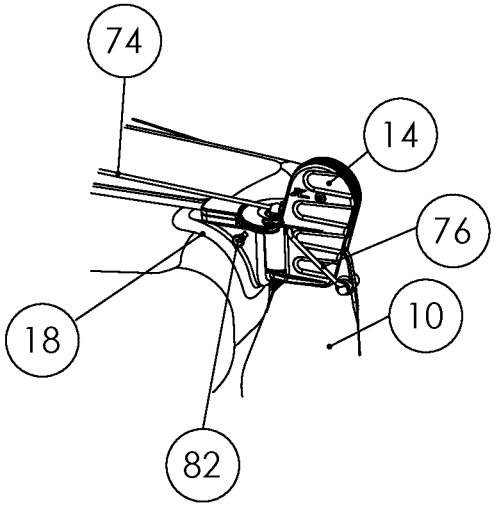
FIG. 10C shows the elements of FIGS. 10A and 10B with the spring loaded quick release pin in place.
Figure 10D:
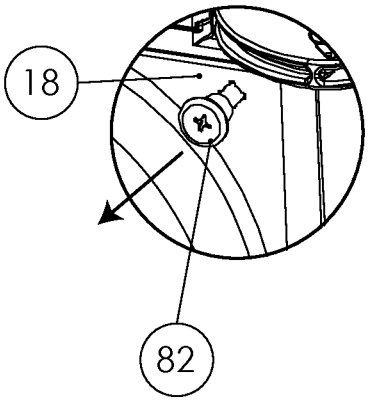
FIG. 10D is a detailed view of the spring loaded quick release pin shown in FIG. 10C.
Figure 11:
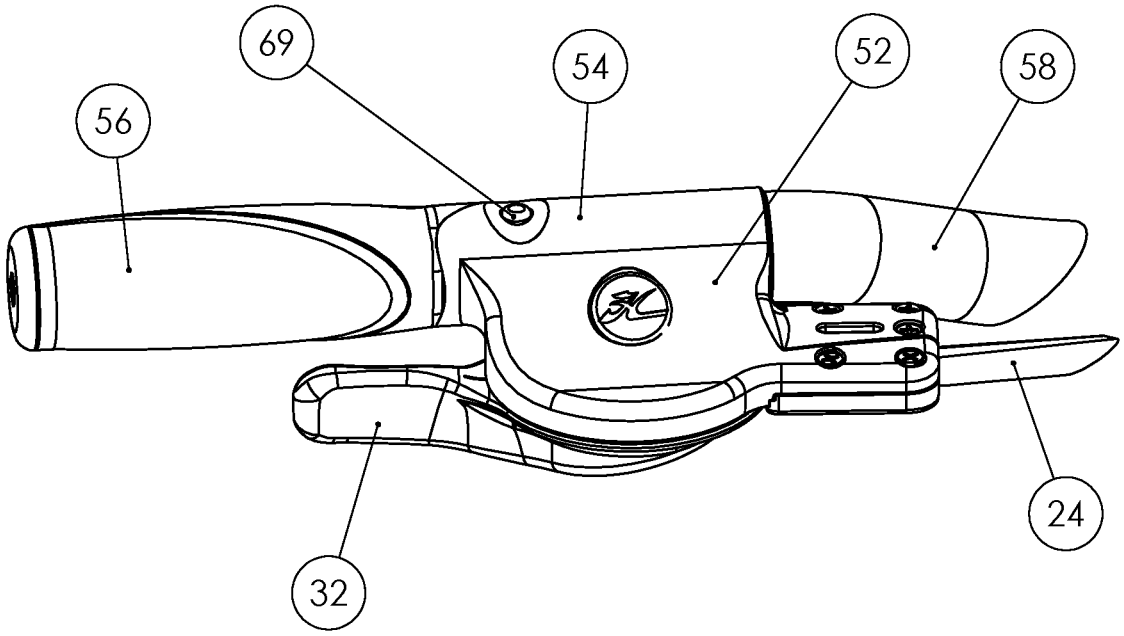
FIG. 11 is a plan view showing the steering handle with quick release elements for releasable attachment to the handle bars of the stand-up pedal board embodiment of this invention as shown in FIG. 8.
Figure 12A:
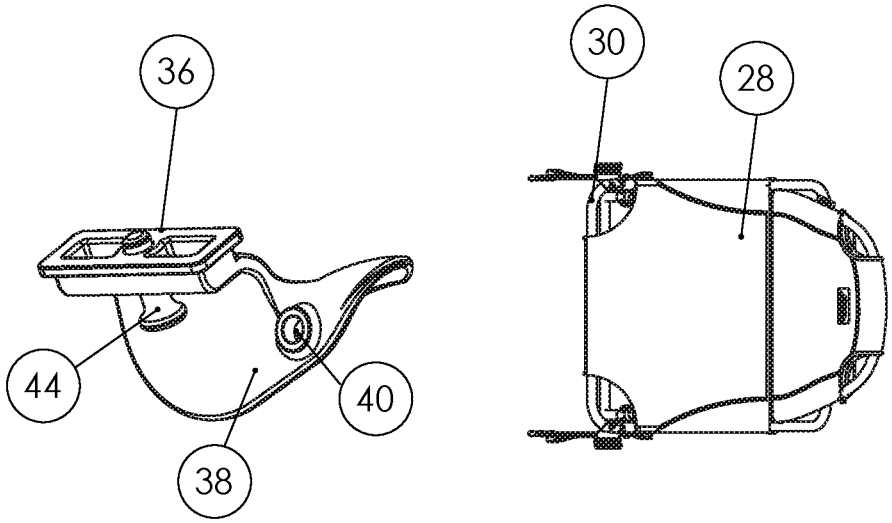
FIG. 12A is a top view of the chair shown in the pedaled sit on kayak watercraft of FIG. 7 together with the retainer for the steering handle and its housing before it is affixed to the tubing of the chair.
Figure 12B:
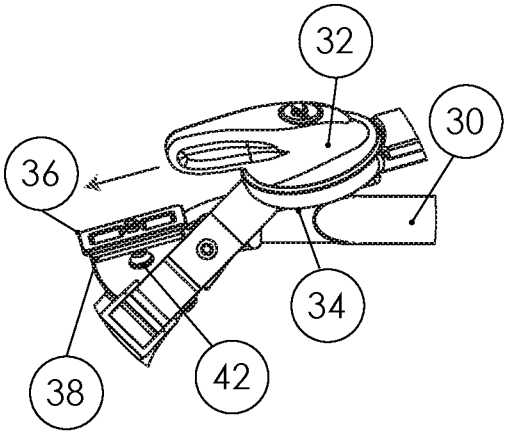
FIG. 12B is a partial perspective view showing the direction of movement to attach the steering handle and its housing to the retainer with the retainer affixed to the tubing of the chair.
Figure 12C:
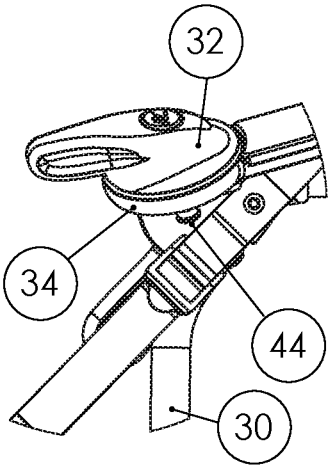
FIG. 12C shows the steering handle with housing releasably attached to the retainer when affixed to the tubing of the chair.
Figure 12D:
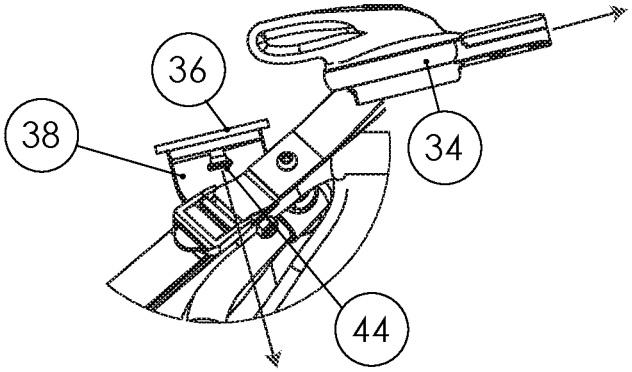
FIG. 12D shows the retainer with a slidable member received in a complementary slot formed in the bottom of the steering handle housing and release of the steering handle with housing from the retainer by pulling on the spring loaded quick release pin.
Figure 12E:
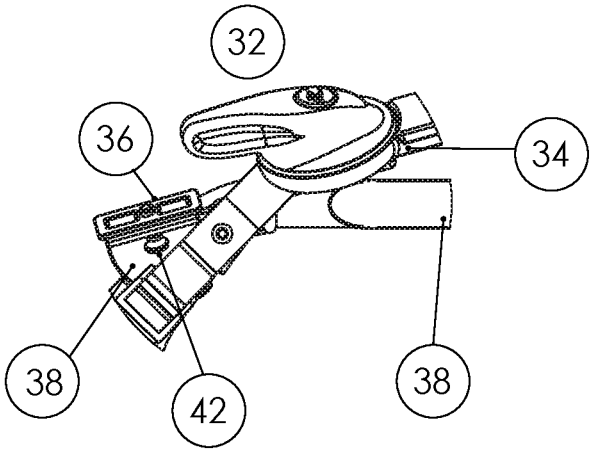
FIG. 12E shows the steering handle with housing released from the retainer by pulling the spring loaded release pin.

The stand-up embodiment is propelled by the operator stepping up and down on pedals 64 to operate flaps 48, FIG. 8.

The free-standing system of this invention can be quickly and readily released simply by pressing the quick release spring button 69 and pulling hollow tubular retainer 54 carrying housing 52 and steering handle 32 from the handlebar 60. In the case of the stand-up embodiment, the free end of the handlebar 60 serves as the retainer for the steering handle and its housing.

In both the sit down and stand up embodiments, the pedals and operator are positioned somewhat midway on the watercraft at the usual distance forward of the rudder.

Referring to the rudder 10 and its quick release, the rudder is carried at the rear end or transom 66 of the kayak, pedal board or other watercraft.

The rudder support 14 along with the rudder 10 is pivoted side to side to steer on vertical shaft 70 carried by rudder mount 12 by the operation of tensile cables 20 and 22 using the steering handle.

The rudder 10 can also be rotated about transverse shaft 72 in rudder support 14 by means of pull rope 74 to raise and lower. The pull rope 74 imparts a pivoting motion to rudder support 14 and rudder 10 about shaft 72. The weight of the rudder 10 carries it through either the stowed or deployed position. The bungee cord 76 keeps the blade in either position, while allowing the rudder to rotate somewhat freely to the rear when striking an obstacle in the water and avoiding rudder damage.

Figure 13:
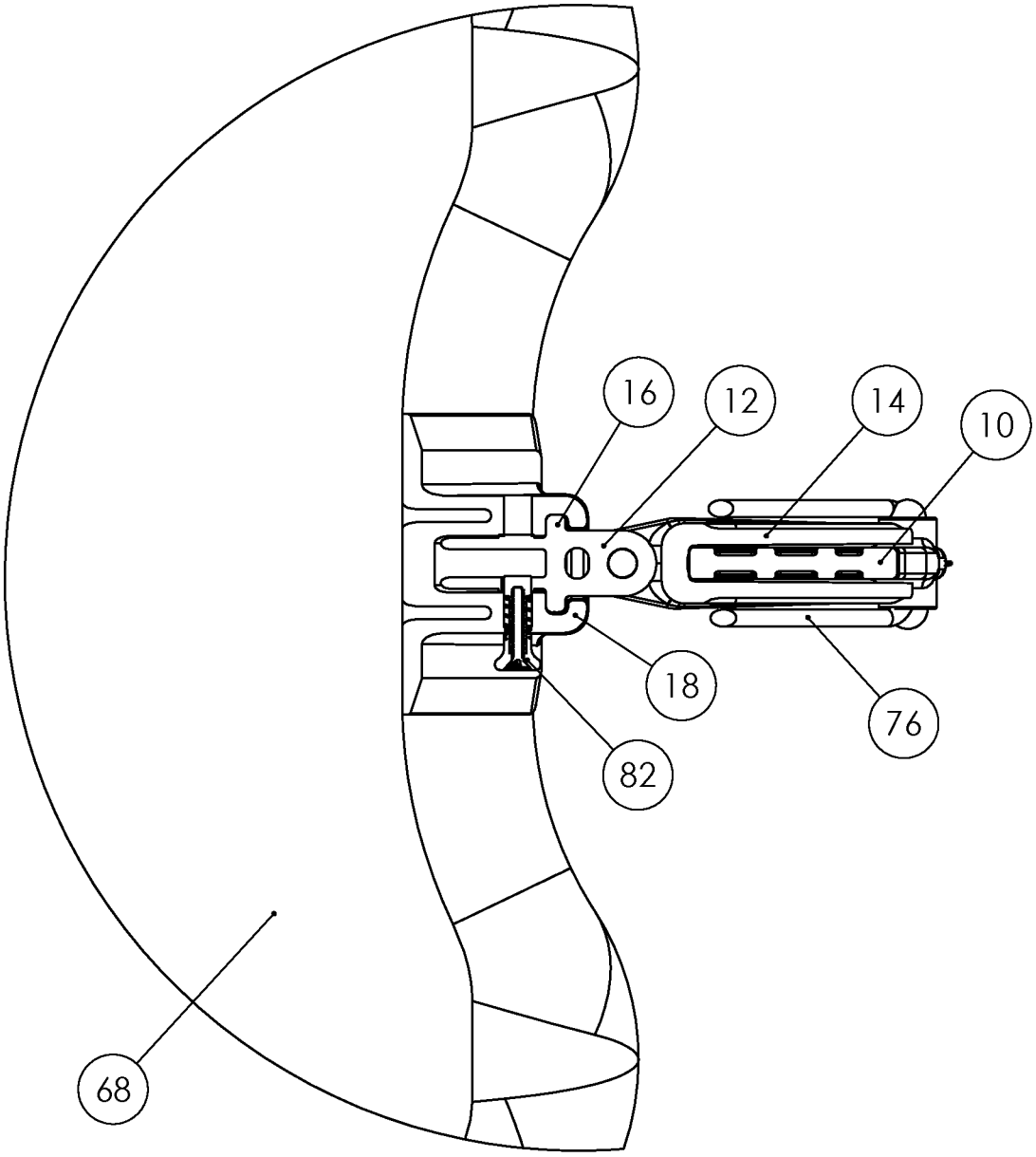
FIG. 13 is a partial top view with parts broken away to show the rudder mount connected to the retainer and the spring loaded quick release pin.
Figure 14:
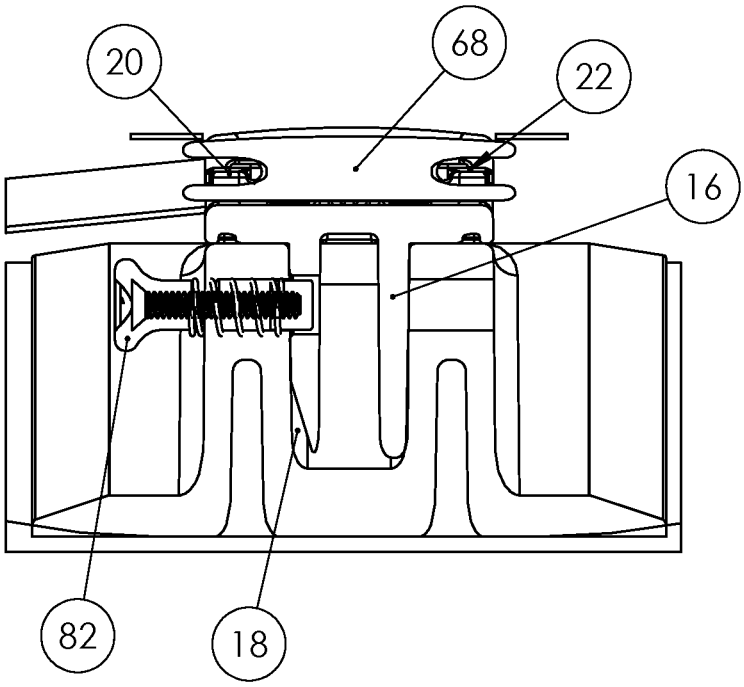
FIG. 14 is a view with parts broken away showing the quick release spring loaded release pin in place and extending into a hole in the retainer to secure the rudder mount to the retainer.
Figure 15:
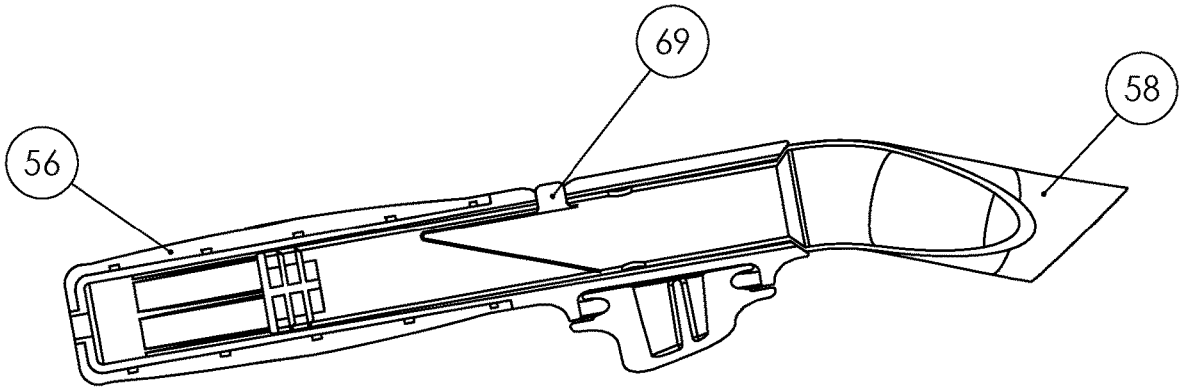
FIG. 15 is a sectional view of the handlebar grip showing the quick release spring button.

The quick release of the rudder is shown in FIGS. 9, 10A through 10D, 13 and 14. The retainer 18 is affixed to the rear of the watercraft. The retainer 18 has a hole 78. The rudder mount 12 also has a hole 80. When projection 16 on the rudder mount is received in the retainer 18, holes 78 and 80 align and a quick release pin 82 can be inserted. The release pin is spring loaded as shown in FIGS. 13 and 14. The entire rudder mechanism is easily and quickly released by operation of the quick release pin 82.

In use, the retainers 18 and 38 can be mechanically attached to the rear surface of the watercraft and the chair tubing, respectively. These elements need not be removeable as they do not interfere with the transport and storage of the watercraft. The handlebar and its upright and the chair can be removed from the watercraft and transported and stored separately.

The quick release elements projection 16, slidable member 36 and hollow tubular member 54 are elements of the quick release mechanism of the system of this invention and complement the retainers or handlebar to complete the quick release function.

What is claimed:

1. A rudder system for a watercraft, the rudder system comprising:

a rudder;

a steering handle coupled to a first release mechanism adapted to releasably secure the steering handle to the watercraft;

a rudder mount adapted to be coupled to a rear of the watercraft by a second release mechanism adapted to releasably secure the rudder mount to the watercraft;

a rudder support on which the rudder is rotatably mounted, the rudder being rotatable relative to the rudder support about a transverse axis; and cables operatively connecting the steering handle to the rudder.

2. A rudder system for a watercraft, the rudder system comprising:

a rudder;

a steering handle coupled to a first release mechanism adapted to releasably secure the steering handle to the watercraft;

a rudder mount adapted to be coupled to a rear of the watercraft by a second release mechanism adapted to releasably secure the rudder mount to the watercraft;

cables operatively connecting the steering handle to the rudder mount to pivot the rudder to steer the watercraft a rudder support on which the rudder is rotatably mounted, the rudder being rotatable relative to the rudder support about a transverse axis; and a pull cord connected to the rudder support whereby the rudder can be rotated about the transverse axis and stowed on a deck of the watercraft.

3. The rudder system of claim 1, wherein the first release mechanism further comprises:

a retainer adapted to be affixed to the rear of the watercraft.

4. The rudder system of claim 1, wherein the second release mechanism further comprises:

a retainer adapted to be affixed to a tubular member carried by the watercraft.

5. The rudder system of claim 1, wherein the second release mechanism further comprises:

a tubular retainer adapted to be received on a free end of a handlebar carried by the watercraft.

6. The rudder system of claim 2, wherein the rudder mount comprises a downward projection adapted to be received in a slot formed in a retainer member affixed to the rear of the watercraft.

7. The watercraft carrying the rudder system of claim 1.

8. The rudder system of claim 3, wherein the first release mechanism comprises:

a release member engageable with a portion of the retainer and a portion of the rudder mount to secure the rudder mount to the watercraft.

9. The rudder system of claim 8, wherein the release member is a release pin insertable through a hole on the retainer and a hole on the rudder mount to engage with the portion of the retainer and engage with the portion of the rudder mount.

10. The rudder system of claim 8, wherein the release member of the first release mechanism is a spring-loaded release pin.

11. The rudder system of claim 1, wherein the first release mechanism and the second release mechanism are operable to release the steering handle and the rudder mount from the watercraft such that the rudder system is separable from the watercraft.

12. The rudder system of claim 1, wherein the rudder support is pivotal relative to the rudder mount about a vertical axis.

13. The rudder system of claim 1, wherein:

the rudder is rotatable relative to the rudder support between a deployed position and a stowed position, and the rudder system further comprises:

a tension member extending between the rudder and the rudder support, the tension member configured to maintain the rudder in the deployed position when the rudder is in the deployed position and to maintain the rudder in the stowed position when the rudder is in the stowed position.

14. The rudder system of claim 13, wherein the tension member is a bungee cord.

15. The rudder system of claim 1, wherein each of the cables are routed through a corresponding arcuate path along a portion of the steering handle.

16. The rudder system of claim 1, wherein, each of the cables are routed through a corresponding arcuate path along a portion of the rudder support.

17. The rudder system of claim 2, wherein:

the first release mechanism further comprises:

a retainer adapted to be affixed at a first location at the rear of the watercraft;

and the second release mechanism further comprises:

a retainer adapted to be affixed to a second location forward of the first location.

18. The rudder system of claim 2, wherein the first release mechanism comprises:

a release pin insertable through a hole on a retainer affixed to the rear of the watercraft and a hole on the rudder mount to engage the retainer with the rudder mount.

19. The rudder system of claim 2, wherein:

the rudder is rotatable relative to the rudder support between a deployed position and a stowed position, and the rudder system further comprises:

a bungee cord extending between the rudder and the rudder support, the bungee cord configured to maintain the rudder in the deployed position when the rudder is in the deployed position and to maintain the rudder in the stowed position when the rudder is in the stowed position.

20. The rudder system of claim 2, wherein each of the cables are routed through a corresponding arcuate path along a portion of the steering handle and a corresponding arcuate path along a portion of the rudder support.

* * * * *